United States Patent [19]

Mächler et al.

[11] 4,363,448

[45] Dec. 14, 1982

[54] MILLING OF CEREALS AND THE LIKE

[75] Inventors: Ernst Mächler, Zuzwil; Emanuel Kummer, Gossau, both of Switzerland

[73] Assignee: Gebrüder Bühler AG, Uzwil, Switzerland

[21] Appl. No.: 106,939

[22] Filed: Dec. 26, 1979

[30] Foreign Application Priority Data

Dec. 22, 1978 [DE] Fed. Rep. of Germany ..... 2855715

[51] Int. Cl.[3] ..... B02C 9/04

[52] U.S. Cl. ..... 241/10; 241/13; 241/30; 241/33; 241/37

[58] Field of Search ..... 241/6-13, 241/30, 33-37

[56] References Cited

U.S. PATENT DOCUMENTS

| | | | |
|---|---|---|---|
| 2,713,460 | 7/1955 | Atkinson | 241/8 |
| 2,847,167 | 8/1958 | Szasz | 241/10 X |
| 4,140,285 | 2/1979 | Linzberger et al. | 241/37 X |

*Primary Examiner*—Mark Rosenbaum

*Attorney, Agent, or Firm*—Oblon, Fisher, Spivak, McClelland & Maier

[57] ABSTRACT

A process and apparatus is disclosed for milling cereal in a milling plant having a control device, such as a computer device, for controlling various process elements of the plant and the operative parameters of those process elements, in which the characteristics of the material to be milled are established together with the characteristics of the required finished product and from those characteristics desired operating parameter values for one or more selected process elements are determined bearing in mind the characteristics of the process elements of the plant, and those parameter values are stored in the control device to be used as control signals for the process elements, and in which such control signals are determined and stored in groups associated with required combinations of material and finished product characteristics, and an appropriate group of parameter values is selected by means of the control device to provide process control signals for controlling the operative parameters of said process elements.

30 Claims, 15 Drawing Figures

MILLING OF CEREALS AND THE LIKE

BACKGROUND OF THE INVENTION

This invention relates to a control system for apparatus used in cereal milling plants.

The invention finds particular application in a mill for producing flour, more particularly baking flour, semolina and medium ground flour in a series of progressive stages.

Modern cereal mills are largely automatic. The heart of the mill, i.e. the milling portion, and more particularly the mill rolls and the cleaning installations are interconnected and actuated via electrical interlocking to such an extent that operation during the starting, operating and output phase can be regarded as completely automatic. The entire stream of product, starting from the raw grain, is automatically conveyed through all the milling stages.

White flour which is one of the main objectives of cereal milling must have a very low ash content. A low ash or husk content is directly contrary to maximum recovery of the endosperm. A large number of factors, e.g. the feel of the flour, the baking properties, taste and smell of the bread, are checked and constantly monitored by the miller and his laboratory assistants, using in many cases their own unaided senses. The reliability of the individual machines, mechanical conveying elements, actuating means, etc. has now been brought to such a high standard that a single man (i.e. the miller or head miller) can without aid, monitor a large mill with a daily output of some 300–400 tonnes.

In recent times, many proposals have been made for further automation of mills. The most obvious idea of all would be simply to control the mill by a computer. However, a single miller is still required. As a result the computer, with the necessary computer expert, is a retrograde step, and likely to lead to over-control of the mill and may endanger the present high level of automation as faults in the computer result in complete shut down of the plant. Although laboratory work has been going on for almost two decades, the computer has not been accepted in milling practice, except for "book-keeping" tasks, where it only collects the necessary information and processes or stores it for accounting and other book-keeping purposes. A yield computer is an example of the book-keeping computer. A yield computer is arranged to continuously monitor the weights of raw flour supplied and the products obtained therefrom, i.e. medium ground flour, bran, etc. from which it calculates the yield for a particular time or from a given load. Mill experts have not so far accepted a central control computer to supervise a mill because they know only too well that it may fail, resulting in complete shut down of the mill.

An important concept in the background of the invention is that a cereal mill should be treated in a manner appropriate to itself and not like a chemical factory or cement factory. animals will not accept fodder except in a form which appeals to them, and the same applies even more to man in his acceptance of flour. A purpose of the mill, therefore, must be to produce flour which meets the needs for baking good bread or for making good paste products. For this, however, the intervention of the miller with his skill and experience is essential. Accordingly an acceptable end product can be obtained only by full co-operation between the miller and the machinery.

One interesting discovery is that a mill must be piloted somewhat in the manner of a modern passenger aircraft. A mill must have an automatic "pilot" which helps the real pilot or miller without replacing him. In both the aircraft and the mill, the "take-off", "flying" and "landing" process must be assisted, but the head miller remains responsible for active guidance and piloting in a supervisory capacity, adding his own perception to the control of the mill process. He must, with his unaided senses, allow for all the important factors, more particularly those which are difficult to measure mechanically but which are critical in the process, and he must be able to give suitable control instructions at any time.

OBJECTS OF THE INVENTION

An object of the invention is to provide a control system for a mill plant which can facilitate control thereof by the miller, i.e. a man, using a minimum number of technical aids or actuating and control means, and guarantee uniform operation so that the mill has optimum efficiency.

It is a further object of the invention to provide such a control system which avoids the shut down of the whole mill plant in the event of a failure in the main or subsidiary parts of such a control system.

SUMMARY OF THE PRESENT INVENTION

In one aspect the invention provides a process for milling cereal in a milling plant having a control device, such as a computer device, for controlling various process elements of the plant and the operative parameters of those process elements, in which the characteristics of the material to be milled are established together with the characteristics of the required finished product and from those characteristics desired operating parameter values for one or more selected process elements are determined bearing in mind the characteristics of the process elements of the plant and stored in the control device to be used as control signals for the process elements, and in which such control signals are determined and stored in groups associated with required combinations of material and finished product characteristics, and an appropriate group of parameter values is selected by means of the control device to provide process control signals for controlling the operative parameters of said process elements.

In a further aspect the invention provides a milling plant for milling cereal, having a control device, such as a computer device, for controlling various process elements of the plant and the operative parameters of those process elements; in which the control device includes storage means in which may be stored groups of operative parameter values for said process elements, which groups have been determined from the characteristics of the raw material to be milled and the desired characteristics of the finished product having regard to the characteristics of the process elements; and in which the control device is arranged to address an appropriate group of operative parameter values in response to an input representative of the raw material and required finished product characteristics and provide a group of corresponding output signals for controlling the operative parameters of said process elements.

In a further aspect the invention provides a control arrangement for apparatus for use in cereal milling having at least one variable operating parameter, the control arrangement comprising means associated with the apparatus for producing a value signal representative of the actual value of said parameter, servo-means associated with the apparatus for varying the actual value of said parameter in response to an error signal, manual means for varying the actual value of said parameter manually, means for producing a desired signal representative of a desired value of said parameter, comparator means arranged to produce said error signal from a comparison between said value signal and said desired signals, and switching means arranged to inhibit the servo means in the event of failure thereof or otherwise to allow manual variation of said parameter by said manual means.

In a further aspect the invention provides a control arrangement for apparatus for use in cereal milling having at least one variable operating parameter, the control arrangement comprising means associated with the apparatus for producing a value signal representative of the actual value of said parameter, servo-means associated with the apparatus for varying the actual value of said parameter in response to an error signal, means for producing by manual adjustment a first desired signal representative of a desired value of the parameter, a computer device including a memory means arranged to select from one or more values of said parameter prestored in said memory means a chosen value and produce a second desired signal representative of a desired value of said parameter, switching means arranged to select the first or second desired signals, and a comparator arranged to produce said error signal from a comparison between said value signal and the selected one of the first and second desired signals.

In a further aspect, the invention provides a cereal milling plant, especially for the production of flour, semolina and medium ground flour, having a number of process zones for example for cleaning, moistening, roller milling, sifting or silo storage of the incoming cereal, intermediate or final products, one or more such process zones including a process apparatus which includes servo-control means and means for interlocking its operation with other apparatus in the milling plant; in which the servo-control means includes a set value generator for a process parameter of the respective process apparatus, an actual value sensor for that process parameter and comparator means with associated drive means to operate the servo-control means in a loop to maintain the parameter at a chosen value; and in which switching means is provided so that the servo-control means of the process apparatus in one or more of said zones individually or collectively may be disconnected so that the apparatus may operate independently of the servo-control loop.

In a further aspect the invention provides a cereal milling plant, especially for the production of flour, semolina and medium ground flour, having a number of process zones for cleaning, moistening, roller milling, sifting or silo storage of the incoming cereal, intermediate or final products, in which a central control device, such as a computer device, is provided to control process apparatus in one or more such process zones, such process apparatus including servo-control means and means for interlocking its operation with other apparatus in the milling plant; in which the servo-control means includes a manually adjustable set value generator for a process parameter of the respective process apparatus, an actual value sensor for that process parameter and comparator means with associated drive means to operate the servo-control means in a loop to maintain the parameter at a chosen value; and in which switching means is provided so that the comparator means associated with such process apparatus in one or more of said zones individually or collectively may be connected to either the central control device or the respective set value generator so that the servo-loop may operate under the direction of the central control device or the associated set value generator.

BRIEF DESCRIPTION OF THE DRAWINGS

In order to promote a fuller understanding of the above and other aspects of the invention, an embodiment will now be described, by way of example only, with reference to the accompanying drawings, in which.

Figure 1:
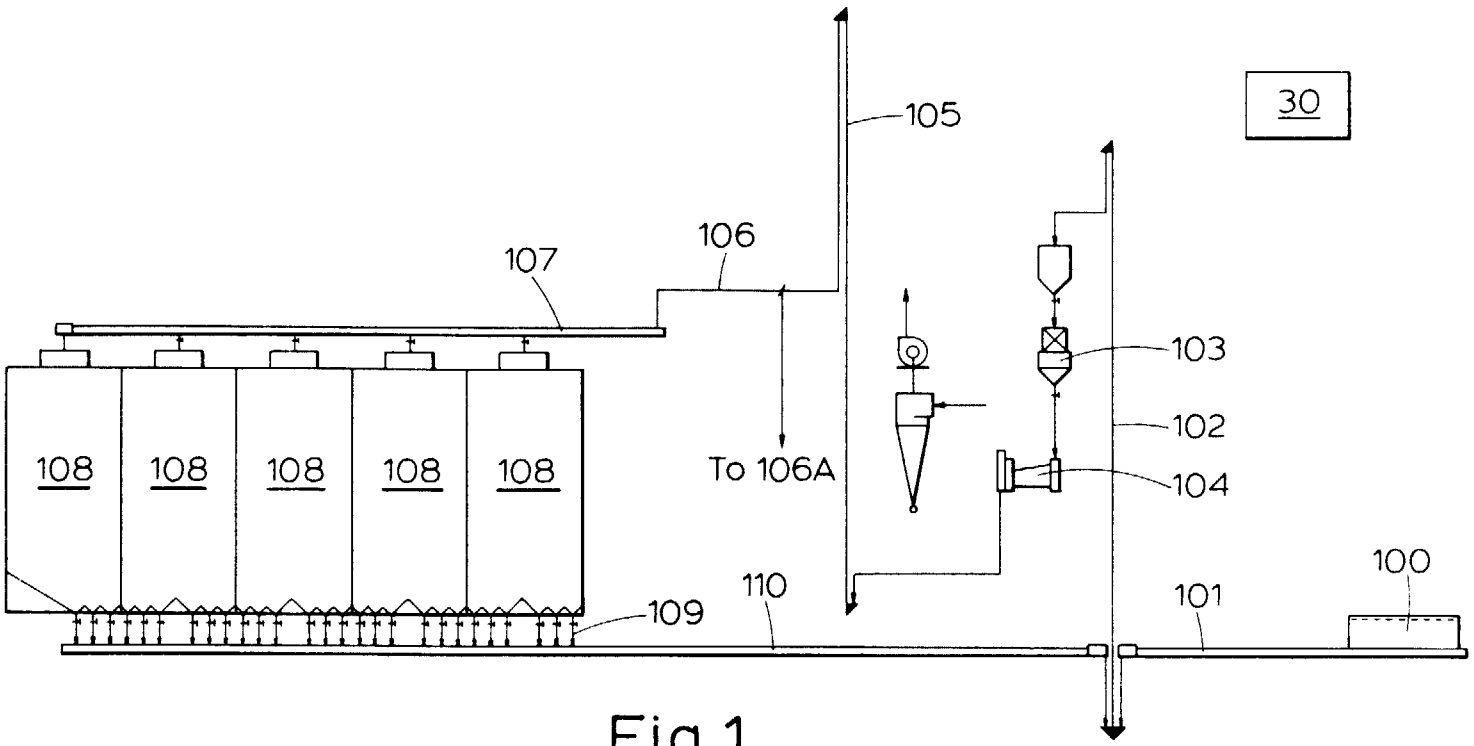
FIGS. 1, 2, 3 and 4 show in schematic outline a flour milling plant from reception storage silos for incoming wheat, or other material, to be milled, through to bagging apparatus for finished milled flour, and which is typical of plants to which the invention is applicable.

Referring first to FIG. 1 there is shown in schematic outline the reception area of a flour mill. Material to be milled, such as wheat, is brought into the reception area by suitable means such as a railway train or road vehicles at 100 and placed on a reception conveyor 101. This takes the wheat to an elevator 102 by which it is lifted to pass through a weighing machine 103, to check the quantity of wheat being taken into the plant, and thence to a cleaning and separating sieve arrangement 104 where an initial cleaning operation is performed on the wheat. The wheat then passes to a further elevator 105 which lifts it to a conveyor system 106. From the conveyor 106 it may be conducted to a further lower conveyor system 107 by which it may be carried to be selectively placed in one or more of a series of intake storage silos 108. Five storage silos 108 are shown in this embodiment, each of these being of 300 metric tonnes capacity and the arrangement of the conveyors is such that any given intake batch of wheat can be directed to a chosen one of the silos so that different intakes of the same or similar types of wheat can be directed to a silo reserved for that type of wheat. Suitable outlet selectors 109 are provided at the bottom of the silos 108, so that the wheat may be selectively taken from the storage silos 108 for processing, and conveyed by a conveyor 110 to the elevator 102 again. The wheat is raised by the elevator 102 to pass again through the weigher 103, the cleaner 104 and the elevator 105 to the conveyor system 106, and it is this time selectively directed to one or more of a group of four temporary storage silos 11 (FIG. 2) by means of a conveyor 106A. Wheat would be taken to the silos 111 in types and quantities determined by the required end product of the mill at a given time.

While the wheat is stored in the silo 108, it may be dried by hot air or other heating devices arranged to operate in the silos in known manner per se, resulting in up to 1 to 2 percent reduction in weight, and thus the weigher 103 also serves to provide a check on the weight of the material taken from the silos for further processing.

The bottom parts of the temporary storage silos 111 are provided with respective feeder devices by which the contents may be fed from the silos through flow rate control devices 114 to a conveyor system 112 and thence to an elevator 113. The flow control devices 114 may be used to control the quantity of wheat taken from each of the silos 111, which may contain wheat of different varieties, to provide a blending capability in the passage of the wheat to the conveyor 112. In the alternative, a given variety of wheat may be taken by the conveyor 112 from a selected one of the silos 111 alone, and passed to the elevator 113 for processing as discussed below.

From the elevator 113 the wheat passes by way of a weighing machine 125 through a sieving arrangement of known design per se indicated at 115 to clean the wheat, and passes thence to a de-stoning arrangement 116 of known design per se where any entrained stones or similar foreign bodies are removed. The wheat then passes to an apparatus 117 of known design per se arranged to separate from the wheat seeds of other species of plant and like foreign material so that substantially only the wheat to be processed is passed on to a further elevator 119, optionally by way of a scouring machine (not shown) if this is required in the particular mill.

The elevator 119 carries the wheat to a station indicated generally at 120 disposed above a group of four watering silos 121. The station 120 comprises means arranged to measure the moisture content of the dry wheat and to provide a basis upon which the amount of water that must be absorbed into the body of the wheat to put it in a suitable condition for milling may be calculated in accordance with experience of that type of wheat; and to add an appropriate amount of water to the wheat.

The wheat can pass from the station 120 to any of the silos 121 where it is allowed to remain in contact with the added water for a period of time (6 to 48 hours) which is determined in accordance with the amount of water required to be absorbed. The wheat is taken from the bottom of the silos 121 by way of flow control devices 122 passed to a conveyor 123 and thence to an elevator 128. The wheat may be taken if necessary to a further watering station disposed above further watering silos for a further measurement of the moisture content. The water absorption process may be repeated with the wheat remaining in the further watering silos in contact with water for a further period of time calculated on the basis of measurement at the further watering station before passing by way of associated flow control devices to a conveyor and thence to the elevator 128. It will be appreciated that blending can be carried out between the wheat put into the various silos 121 by means of the flow control devices 122 feeding to their associated conveyors.

It should be understood that the extent to which moisture must be added is dependent on the initial moisture content of the wheat to be processed. When the wheat comes from a hot dry climate, more moisture must be added to reach the desired moisture content and in such cases the double treatment discussed above is needed. If the wheat has a higher initial moisture content then only a single treatment is needed and the second stage may be dispensed with, the conveyor 123 leading as discussed straight to the elevator 128. Again more than four silos 121 may be provided in each stage with associated flow control valves to allow for blending from more varieties of wheat, or for greater throughput of wheat.

The elevator 128 carries the wheat up to a machine 129 which scours the surface of the wheat in known manner per se. The wheat then passes to a surface moisture treatment device indicated at 130 which is arranged in known manner per se to spray the wheat surface with water to increase the moisture content of the surface bran only of the wheat grains. The wheat remains in a dwell silo 131 for a short period of time, which may be some 10 minutes, to allow that moisture to be absorbed into the surface only of the wheat grains whereafter it passes to a weigher of known design per se indicated at 132 by which the quantity of wheat passing to the next stage in the process may be determined.

Figure 2:
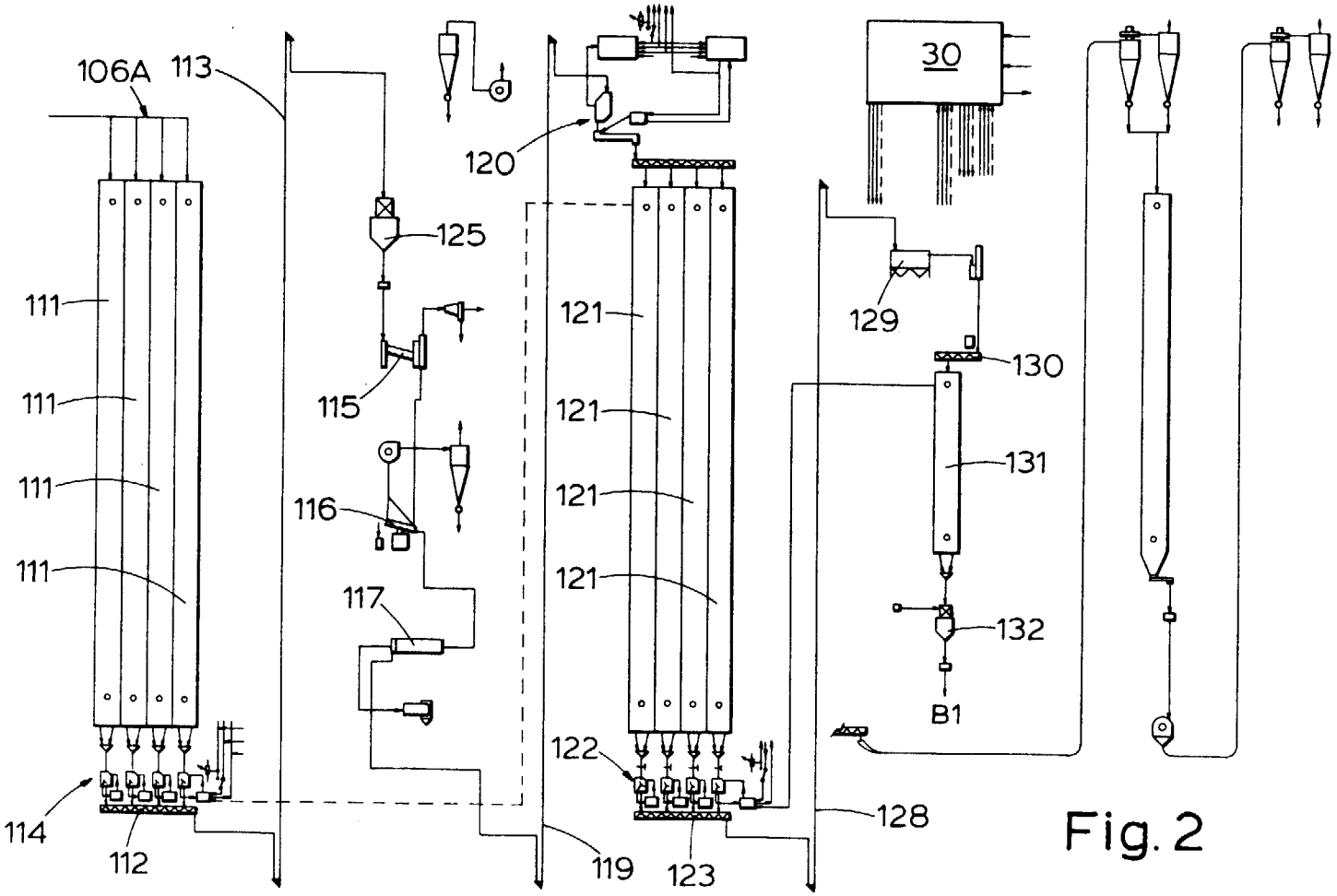
Figure 3:
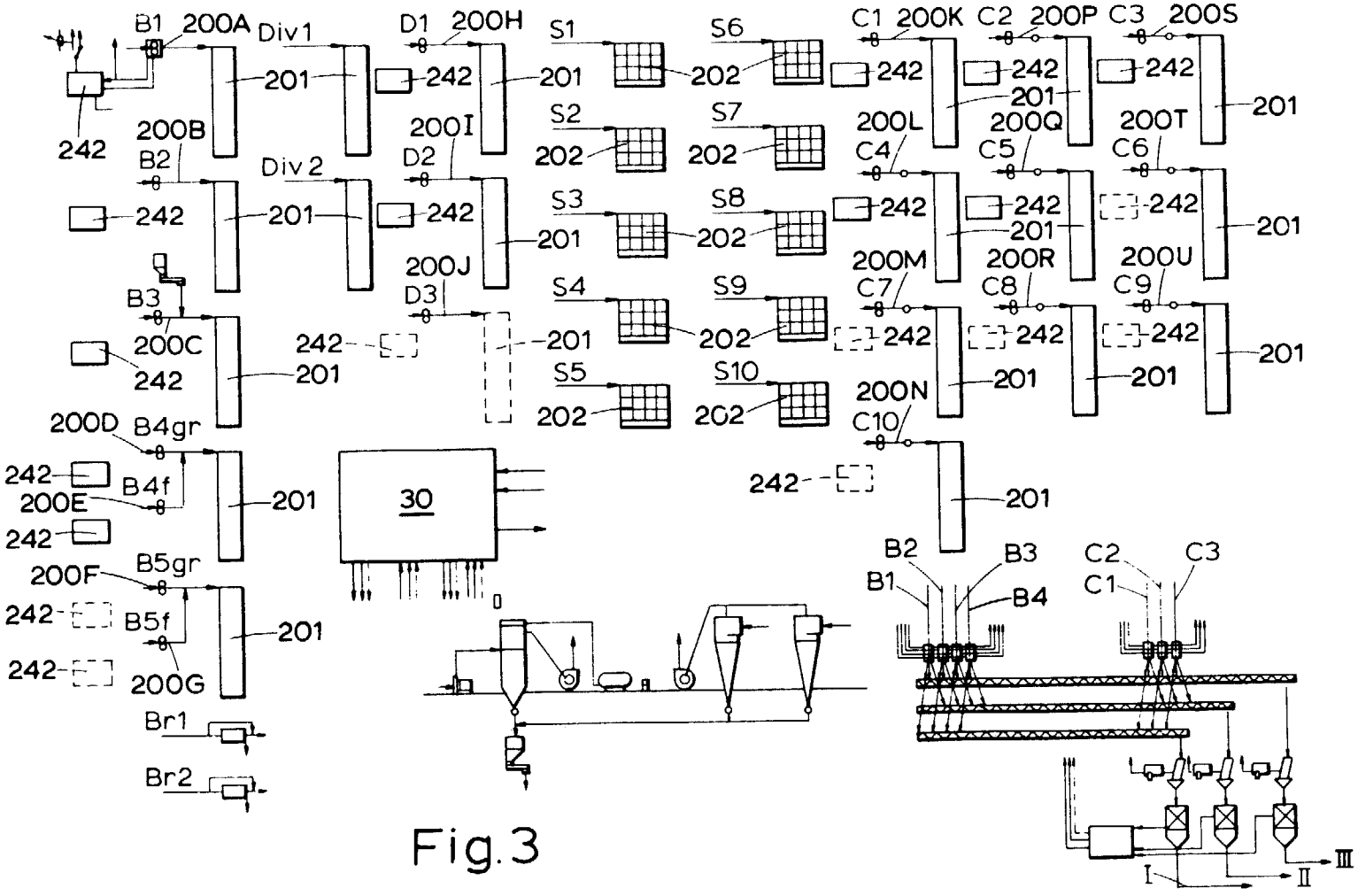

FIG. 3 shows in block schematic outline a typical assembly of roller mills, sieving machines and purifiers for processing the wheat leaving the weigher 132 of FIG. 2.

Figure 5:
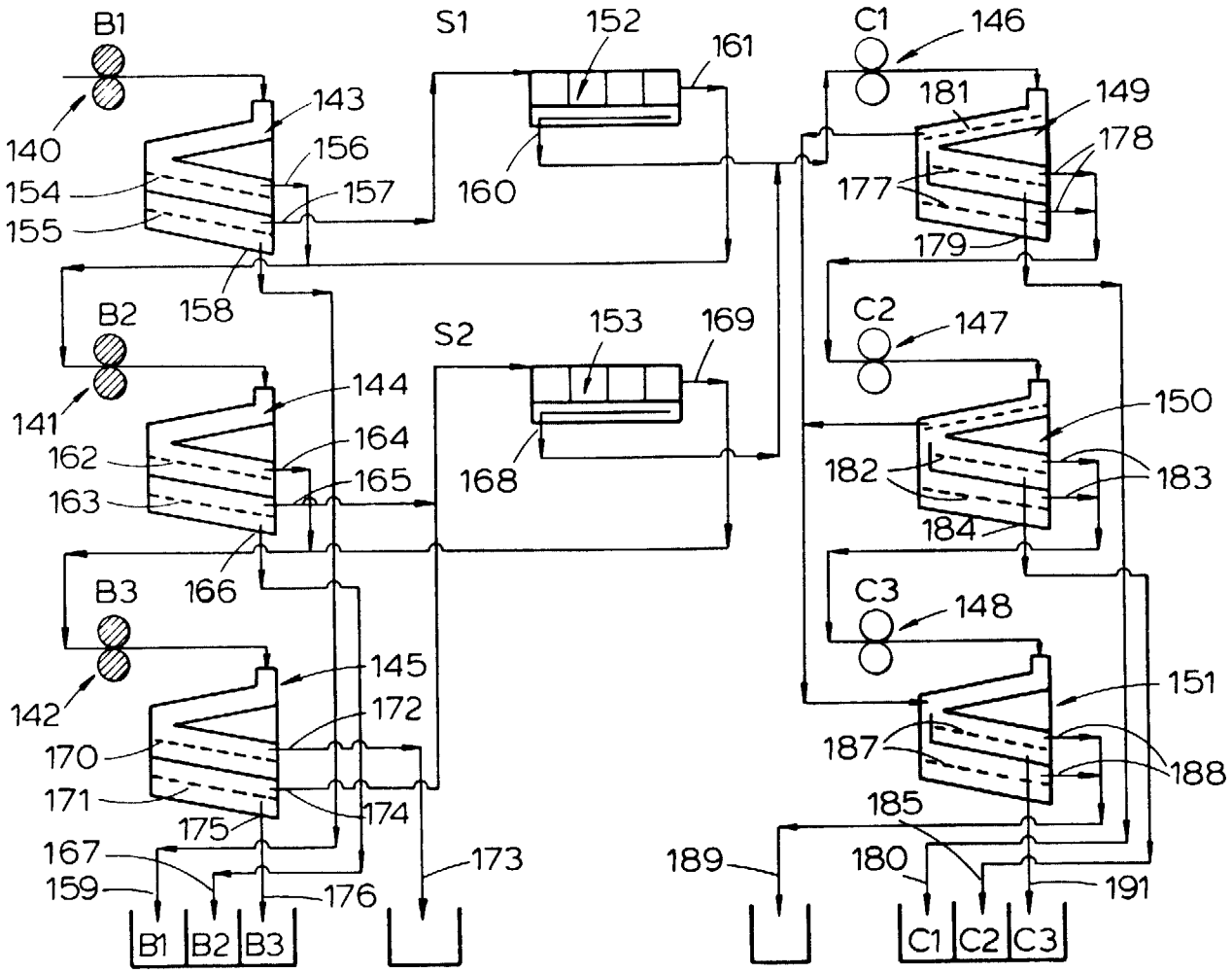
FIG. 5 shows in more detail a typical flow path through a roller mill arrangement of the kind indicated schematically in FIG. 3.

FIG. 5 shows by way of example a flow path for wheat through an assembly of six roller mills, six sifters, and two purifiers, so that a typical installation may be more readily understood.

The assembly comprises three breaker roller mills 140, 141 and 142 with associated sifters 143, 144 and 145, and three smooth roller mills 146, 147 and 148 with associated sifters 149, 150 and 151. Interposed between the breaker rolls and the smooth rolls are two purifiers 152 and 153. The roller mills, sifters and purifiers are all of known design per se, except for the adaptation of the roller mills for automatic control in a manner to be discussed in more detail below.

Wheat to be milled passes from the weigher 132 to the first break rolls 140 and thence to the sifter 143. The sifter 143 comprises two sieves a first 154 of some thirty wires to the inch and a second 155 of some one hundred and fifty microns mesh size. Three outlets from the sieve 143 indicated at 156, 157 and 158 thus provide over-tailings, semolina, and flour respectively.

The flour from the outlet 158 passes to an outlet line 159 from the assembly. The over-tailings from the outlet 156 pass on to the next break rolls 141. The semolina from the outlet 157 passes to the purifier 152 in which clean semolina or partly ground flour is extracted from the outlet 160 whereas bran with remaining attached endosperm is separated and leaves by the outlet 161 to join with the over-tailings from the outlet 156 of the sifter 143 to pass to the break rolls 141. The clean semolina from the outlet 160 passes to the first set of smooth rolls 146.

The material passing through the break rolls 141 continues to the sifter 144 which contains a first sieve 162 of some thirty-six wires to the inch and a second sieve 163 of some one hundred and thirty-two microns mesh size, and which has an outlet for over-tailings 164, an outlet for semolina 165 and an outlet for flour 166. The flour from outlet 166 passes to an outlet 167 from the assembly while the over-tailings from the outlet 164 pass to the last break rolls 142. The semolina from the outlet 165 passes to a second purifier 153 which has an outlet 168 for clean semolina which passes to the first smooth rolls 146, and an outlet 169 for bran and residual endosperm which passes to the last break rolls 142.

The material from the last break rolls 142 passes to the sifter 145 which has a first sieve 170 of some forty wires to the inch and a second sieve 171 of some one hundred and thirty-two microns mesh size. The sifter 145 has an outlet 172 for over-tailings which pass to an outlet 173 from the assembly which is for course bran. The sifter 145 has an outlet 174 for semolina which passes to the second sifter 153, and an outlet 175 for flour which passes to an outlet 176 from the assembly.

The material from the smooth rolls 146 passes to a sifter 149 which has two sieving stages 177 operating in parallel, and having a mesh size of some one hundred and fifty microns. The sifter 149 has outlets 178 for over-tailings which pass to the second smooth rolls 147, and an outlet 179 for flour which passes to an outlet 180 from the assembly. The sifter 149 has a preliminary sieve 181 having some forty wires to the inch, and the over-tailings from that sieving stage pass to the final sieve 151. The over-tailings from the sieve 181 will be largely bran, but will include some entrained flour which is separated in the final sifter 151.

The material from the second smooth rolls 147 passes to the sifter 150 which has two sieves 182 of some one hundred and thirty-two microns mesh size operating in parallel to produce over-tailings at an outlet 183 which pass to the last smooth rolls 148, and flour at an outlet 184 which passes to an outlet 185 from the assembly. The sifter 150 also has a preliminary sieve 186 of some fifty wires to the inch the over-tailings of which pass in a similar fashion to the final sifter 151.

The material leaving the final smooth rolls 148 passes to the sieve 151 which has two sieves 187 operating in parallel, each of some one hundred and thirty-two microns mesh size. The over-tailings from these sieves leave by an outlet 188 to pass to an outlet 189 from the assembly which is for fine bran. Flour leaves the sifter 151 by an outlet 190 to pass to an outlet 191 from the assembly for flour.

Thus it can be seen that the material entering the first break rolls 140 is progressively broken down sifted and purified to produce three grades of flour on the outlets 159, 167, 176, 180, 185 and 191 which are labelled in FIG. 5 as B1, B2, B3, C1, C2, C3 respectively and the bran is separated to leave through outlets 173 and 189. It must be appreciated that FIG. 5 and the description thereto is directed to a simplified example of such an arrangement, and the number of roller mills, sifters and purifiers which are provided in an actual installation is chosen in dependence upon the type of material to be handled by a given plant, and the quantities of that material and the product to be produced. Thus FIG. 3 is a schematic representation of a large plant having up to twenty roller mills indicated at 200, with up to twenty sifters indicated at 201 and up to ten purifiers indicated at 202.

Figure 9:
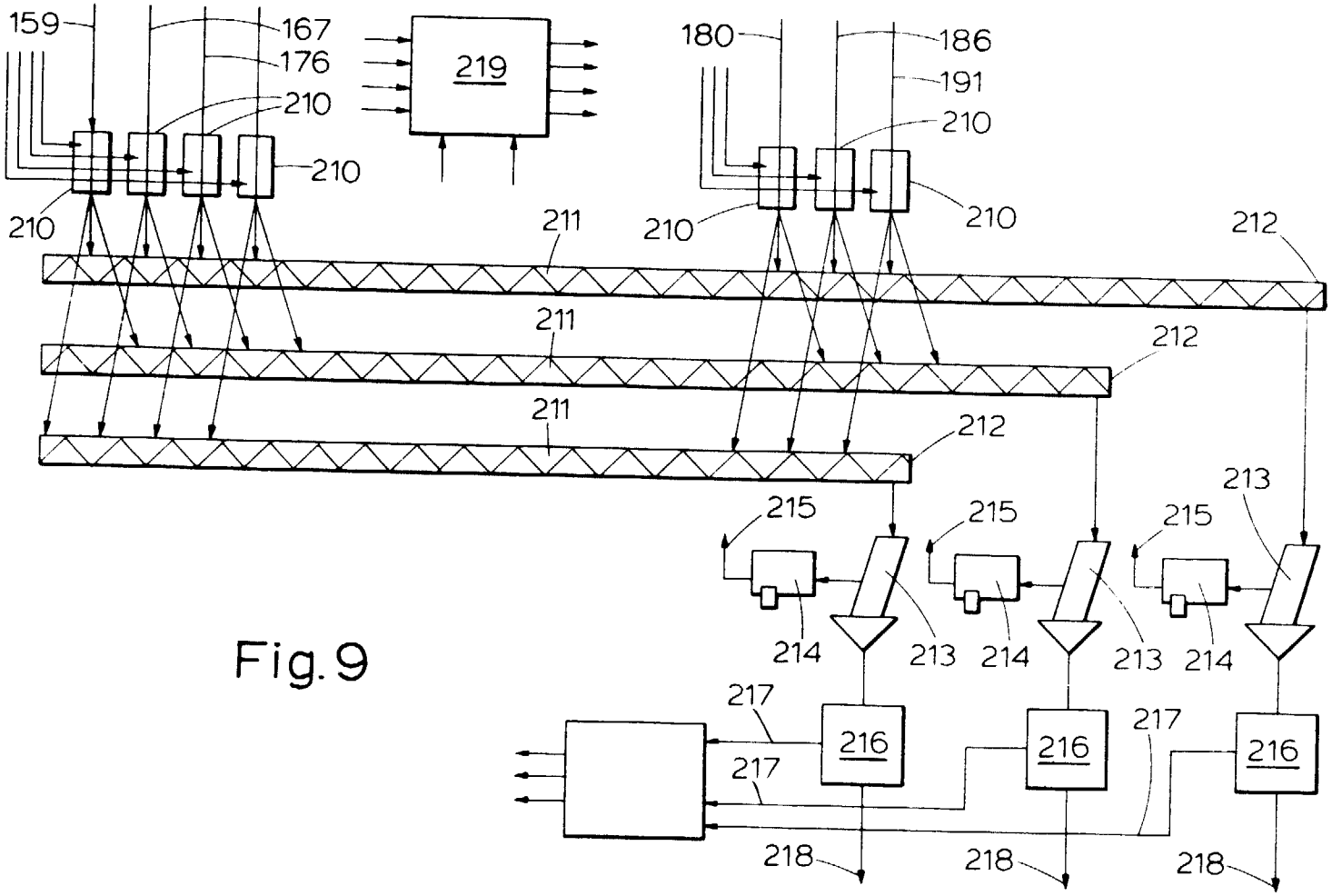
FIG. 9 shows in more detail the blending of flows from various roller mills and separators in FIGS. 3 and 5.

FIG. 9 shows in schematic outline the arrangement for blending the flour from the various outlets 159, 167, 176, 180, 185 and 191 of FIG. 5 into finished product. The outlets are connected to respective flow diverter valves 210 which are three-way control valves so that the flow of flour on the outlets can be directed selectively to one of three mixing conveyors 211. Thus it can be seen that in each of the conveyors 211, by selective operation of the valves 210 the various grades of flour produced can be blended together along the three channels provided by the conveyors 211. The conveyors 211 are preferably of a vibratory horizontal type which promotes mixing of the flour therein as it passes along to one end 212 where the finished flour product leaves the conveyor 211 to pass to a respective colour intensity meter 213 which is an electronic/electrical device arranged to give a print-out at 214 of a measure of the colour intensity of the finished product, and an electrical signal at 215 which is related to that colour intensity. The finished flour product passes from the meter 213 to a finished product weighing machine 216 which gives on the line 217 an electrical signal indicative of the weight of finished product passing through the weighing machine and thence to an outlet conduit 218 to pass to finished product storage and management.

Figure 4:
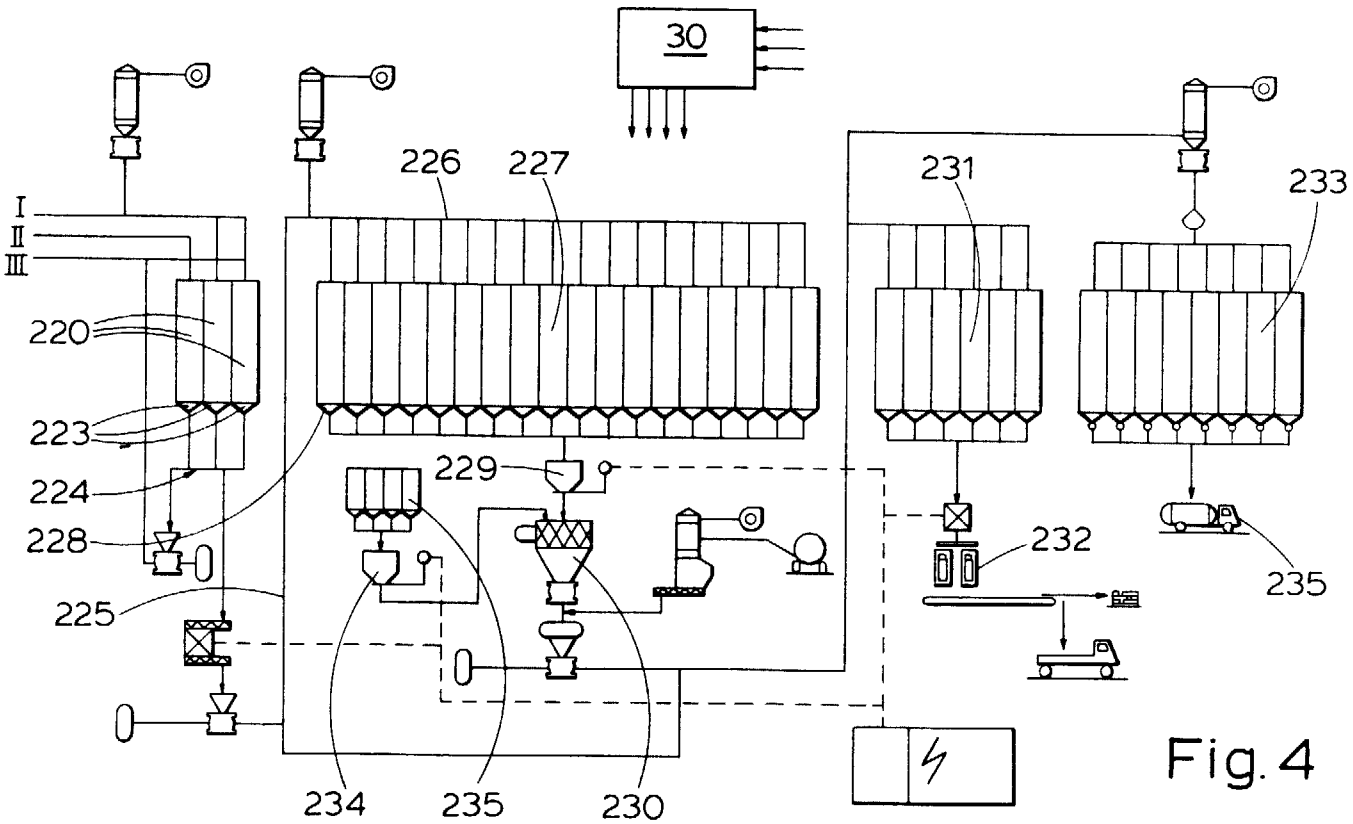

FIG. 4 shows the arrangement for storing and bagging the flour produced in the milling/separating arrangement of FIGS. 3 and 5. The finished flour of the three blends leaving the milling arrangement in the conduits 218 is elevated by a group of pneumatic elevators to be stored in selected ones of a group of three mixing silos 220. The various grades of flours from the three conduits 218, may be individually mixed by re-circulation through the silos 220 or those grades may be mixed together by re-circulation through one of the silos. Vibratory feeder devices 223 are provided one at the bottom of each of the silos 220 to feed flour therein onto a conveyor system indicated generally at 224 by which it may be re-circulated for mixing or carried to an elevator 225 onto a conveyor system 226. The conveyor system 226 is arranged so that it can carry the flour to the top of a series of storage silos 227 where the finished flour can be stored in various types and grades.

The silos 227 are each provided with vibratory feeder devices 228 by which flour therein may be fed by way of a weigher 229, to a mixer 330, where different types of flour may be further mixed and returned to a selected storage silo; or passed either to temporary storage in silos 231 prior to passing to bagging machinery 232, or passed to temporary storage in silos 233 for loading on bulk transport vehicles such as lorry 235. The control of the vibratory feeds and other conveyor elements may be directed by a computer device indicated schematically at 30. Additives for the flour such as vitamins may be stored in bins 236, and added to the mixer 230 by way of a weigher 234 again and on the control of the computer 30.

Also shown in FIG. 4 is a storage silo 229 with associated equipment, collecting devices and elevators and feeding devices in which bran and other waste material from the various stages of operation of the plant, such as the outlets 173 and 189 in FIG. 5, are collected and stored for subsequent use, for instance in animal feed stuffs.

FIGS. 10, 11, 12 and 13 show in schematic block outline an electrical/electronic control system for the control of the plant described above. The various machine elements in the plant described above may be arranged in conventional manner to operate under the control of electrical, electromagnetic and electromechanical control devices, with various electric motors and other actuators being used to drive the various machine elements and to operate various control functions on those machine elements. Such a control arrangement involves electrical interlocking to ensure safety of operation of the plant and proper sequence of operation of the plant in known manner per se. The conventional electrical control equipment and interlocking arrangements are indicated in FIGS. 10, 11, 12 and 13 by the reference block 14 and the various associated control actuators and like devices are indicated by the reference block 16.

An embodiment of the control system of the invention will now be described, with particular reference to the control of only some parts of the plant discussed above, in particular the control of the assembly of roller mills for milling the wheat to flour (FIGS. 3 and 5).

In this consideration the discussion will concentrate initially on one process parameter in the operation of the mill rolls, that is to say the roll gap parameter value.

Figure 10:
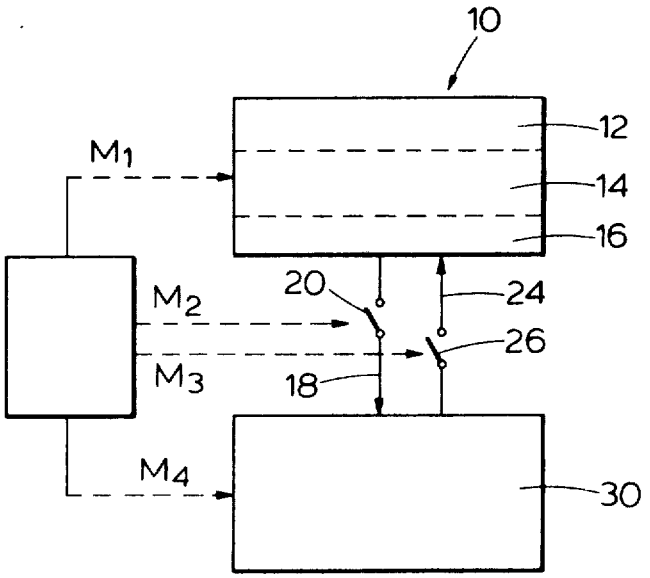
FIG. 10 shows a block circuit diagram of a control system for use in various parts of the plant of FIGS. 1 to 8.

Such an assembly of mill rolls is indicated generally at block 10 in FIG. 10 and this assembly comprises the actual machinery indicated at 12 and the interlocking and actuating elements discussed above associated with those mill rolls are indicated at 14 and 16.

Figure 6:
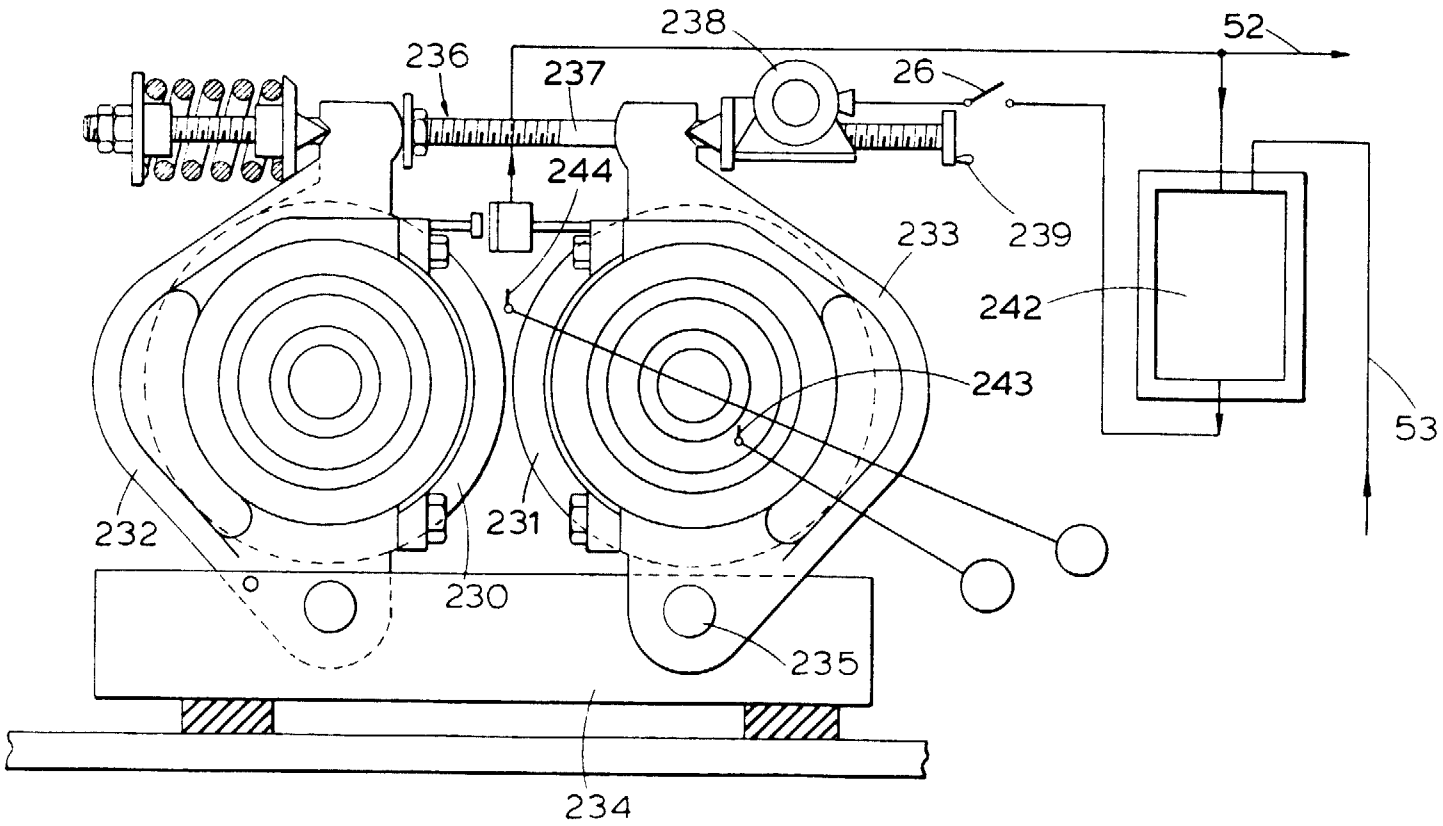
FIG. 6 shows in more detail one of the roller mills in FIGS. 3 and 5.

FIG. 6 shows in schematic outline a typical roller mill machine in which a pair of mill rolls 230 and 231 are rotatably mounted in respective housings 232 and 233 which are in turn mounted on a base or frame 234. The housing 232 is fixed on the base 234 whereas the housing 233 is pivotable about an axis 235 so that the roll 231 may be swung in the housing 233 relative to the roll 232 thus to control the milling gap between them. A lead screw actuating device shown schematically at 236 is arranged to be operative between the housings 232 and 233 so that rotation of the lead screw 237 adjusts the separation of the housings and thus the roll gap. An electric servo-motor 238 with suitable reduction gearing is provided to drive the lead screw 237 under the control of a servo amplifier. A handle device 239 which may include suitable reduction gearing is also provided on the lead screw so that the roll gap adjustment may be made manually by the miller.

A probe 240 is provided on the housing 232 to cooperate with a transducer 241 which is mounted on the housing 233 and arranged to give an electrical signal which is dependent on the distance between the probe 240 and the transducer 241 and which is thus dependent on the gap between the rolls 230 and 231. A servo control system including a comparator device and a servo amplifier indicated generally at 242 is provided to control the servo motor 238 in response to a comparison of the output signal from the transducer 241 and an electrical signal indicative of a desired roll gap value provided on an input line 53, to produce an error signal which is amplified to control the servo motor 238 in known manner per se. Thus the roll gap may be set by the servo motor to a value in accordance with any desired value signal on the line 53 and maintained at that value. A switch 26 is provided between the servo motor 238 and the control amplifier 242 so that the servo motor may be disconnected and the lead screw operated manually by the handle device 239.

Thus in this typical machine element there is provided a first level of control that is to say manual control by the handle 239, and a second level of control that is to say automatic control by the servo motor 238 to maintain the roll gap to a value demanded by the signal on the line 53. In the event of failure of the servo control system for any cause, or if otherwise desired, the switch 26 may be opened and control can revert from the second level of automatic control to the first level of manual control.

Each of the roller mills of FIGS. 3 and 5 may be equipped in the fashion discussed with reference to FIG. 6 although in some instances it may be that only selected ones of the roll pairs are so arranged particularly the earlier roll pairs such as 200A, B, C, K, P and S, the remainder being only manually controlled and adjusted by the miller.

Figure 11:
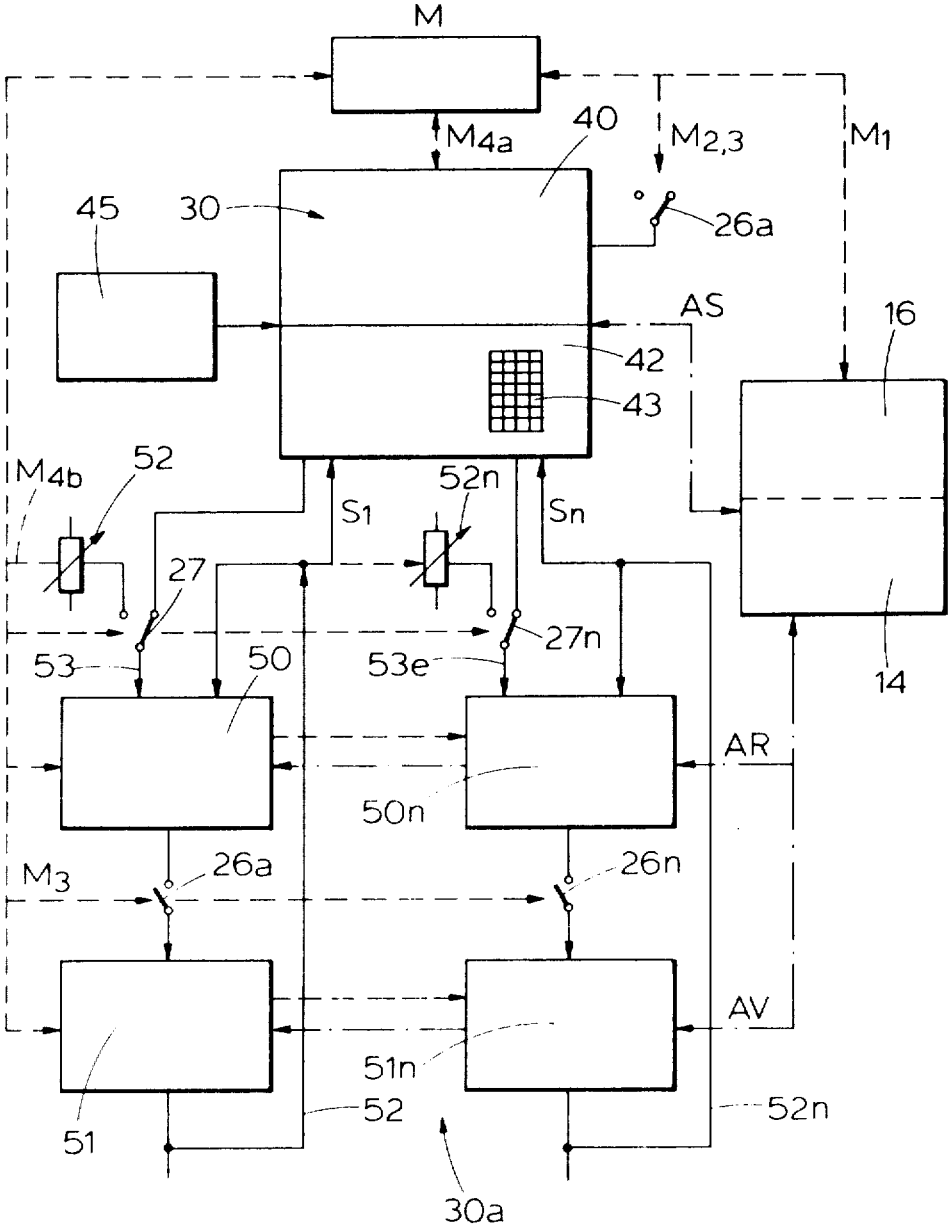
FIG. 11 shows the control system of FIG. 5 in more detail.

The mill rolls of FIGS. 3 and 5 which may be servo controlled are examples of process elements in the mill which may be considered as being situated in process zones indicated at 51 through to 51N in FIG. 11. The associated servo control amplifiers 242 are examples of control units indicated at 50 through to 50N. A line 53 to each control unit 50 is connected to an associated switch 27 by which it may be selectively connected to a device 52 by which an electrical value such as voltage may be manually set to give a set value representative of the desired roll gap parameter value, or to a line leading to a control computer device 30 which is arranged to provide an electrical signal corresponding to the desired roll gap parameter value.

Thus by means of the switch 27, the control of each process zone, of which the roller mill is an example, can be switched from the second level of control discussed above in which the desired roll gap value is determined by the manual setting of the device 52, to a third level of automatic control in which the roll gap value is determined by the computer device 30 in accordance with a programme operative in that computer device. In the event of failure of the computer device the switch 27 can be operated so that the setting control of the roll gap reverts from the third level of automatic control, back to the second level of manual setting of the automatic control given by the servo system.

It will be seen that each roller mill or other process zone may be similarly provided with such second and third level control and that in the event of failure of the computer device 30 they can all be reverted on operation of the switches 27 to the second level of control, whereas in the event of failure the servo system in any one of the process zones, that process zone can revert on operation of the associated switch 26 to the first level of manual control, without affecting the third level control of the remaining process zones by the computer device 30.

The computer device 30 comprises two basic parts. The first is a programmed processor 40 with associated control and access key-board and display devices for use by the miller, and the second is a storage or memory device 42 in which the various desired values of operating parameters at different process zones of the plant, in the specific example discussed above the roll gap, are stored. Thus from previous experience, a tabulation of parameter values for all the process zones under the control of the computer device 30, which are applicable to a given milling operation for a given wheat or other material to be milled, may be pre-stored in the memory 42. The miller may by entry on the key-board of the processor 40 select a pattern of parameter values, such as the roll gap values discussed above, applicable to the circumstances which he is faced with in operation of the plant and the very nature of the plant, so that the computer device 30 may automatically under the third level of control set the various process elements in the process zones to operate at various pre-stored parameter values and these values will be maintained at the desired values by the associated servo systems.

The pre-stored parameter values may be up-dated at any time by the miller. To achieve this the signals corresponding to the actual values of parameter values, such as the measured roll gap appearing on the lines 52 are connected by lines S1 to the computer device 30. Thus if the miller manually adjusts any particular parameter value such as a roll gap while the process element is switched to the first level of control by means of its associated switch 26, to improve the performance of the plant at any given time, that new value can be substituted or stored separately in the memory 42 by appropriate access and entry through the processor 40. Similarly, if the miller switches any process zone to second level control by the associated switch 27, he can adjust the parameter value by means of the associated set value device 52 and again the new value can be stored.

The processor 40 may be provided by sensing means indicated at 45, with signals conveying information as to various ambient conditions such as ambient temperature and humidity, the measured moisture content of wheat to be milled and flow properties of wheat to be milled, and the processor can be programmed to modify the desired parameter values set up in the various process zones either by computing to modify the values taken from the memory 42 in the initial setting up of the machine for the particular material to be milled, or by modifying the addresses from which the processor 40 selects the particular values and thus to select different pre-stored values derived from experience.

Similarly the processor 40 may be provided with information as to the conditions at each particular roller mill such as roll temperature as sensed by sensor 243 (FIG. 6), temperature of product and mill roll pressure as sensed by sensor 244 (FIG. 6), power consumption, roll speeds both relative and absolute, or conditions at other process zones and it can be programmed to modify the roll gap value demanded for each particular mill roll pair to compensate for any distortions which these factors may have.

While the above discussion has been with regard to controlling the mill roll gap, it would be appreciated that mill roll pressure could equally be measured by a transducer similarly arranged to that indicated at 408, and the control system arranged to operate to control the mill roll pressure. Again if desired, the operating parameter of which the actual value is measured and compared with a desired value signal need not be the parameter which is directly varied by the servo motor or system. Thus roll pressure might be the parameter measured and compared while the servo controls the roll gap resulting in a related and simultaneous variation in roll pressure.

The miller in control of the milling plant is indicated in FIGS. 10, 11, 12 and 13 at M and dotted lines are indicated at M1, M2, M3 and M4 to indicate channels of manual control for the miller. Lines AS, AR and AV indicate schematically the interaction of the conventional electrical and interlocking systems 14 and actuators 16 with both the computer device 30 and the control devices or amplifiers 50 and the process elements in the process zones 51.

While discussion of the control system shown in FIGS. 10 and 11 has been directed to the roller mills of FIGS. 3 and 5, it will be appreciated that the other process elements in other process zones or stages such as those shown in FIGS. 1, 2 and 4 may each, as applicable, be controlled by a similar control system under an associated computer device 30.

The flow control devices 114, 122 and 126 in FIG. 2 are a further example of process elements in other process zones which may be controlled by the computer device 30.

Figure 7:
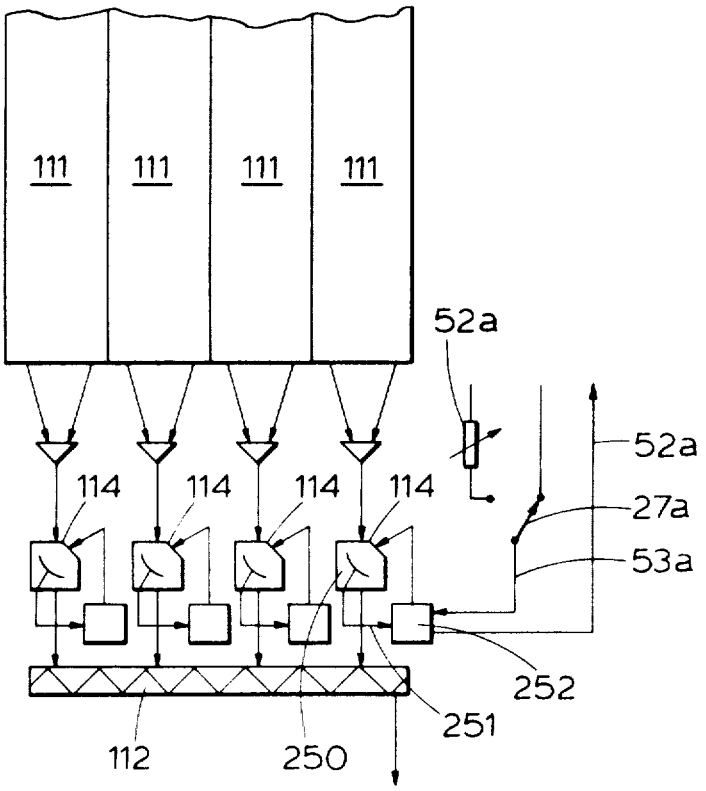
FIG. 7 shows in more detail the flow control from silos in FIG. 2.

FIG. 7 shows such flow devices in a little more detail, and illustrate the flow devices 114 although the others operate in an exactly similar manner.

Each flow device comprises a pivotally mounted plate 250 which is resiliently biased against angular deflection by the momentum of grain or other material falling on the plate as it flows through the device. The angle of deflection is converted to an electrical signal on the line 251 by means of a suitable transducer not shown, and this electrical signal is compared with a desired value electrical signal on the line **53*a* in a comparator and servo amplifier indicated at 252 to provide a control signal on a line 253 which is operative to adjust the position of a flow control valve embodied in the device. Thus it can be seen that the flow is controlled by a servo loop to a value set by the signal on the line 53. A signal indicative of the actual flow value is available on the line 52*a*. Line 53*a* is connected to a switch 27*a* so that line 53*a* can be connected to a manually adjustable set value device 52*a*** if desired.

Thus is can be seen that the flow control device 14 can operate under the third level of control as the roller mill discussed above, being controlled by the computer device 30 in an exactly similar manner, or in the alternative through operation of the switch **27*a*, it can be reverted to a second level of control in which the servo loop is under the control of the set value device 52*a***.

Again if the line 253 is provided with a switch similar to the switch 26 in the roller mill arrangement, and the flow control valve is provided with manual adjustment, it could revert to first level control.

Figure 8:
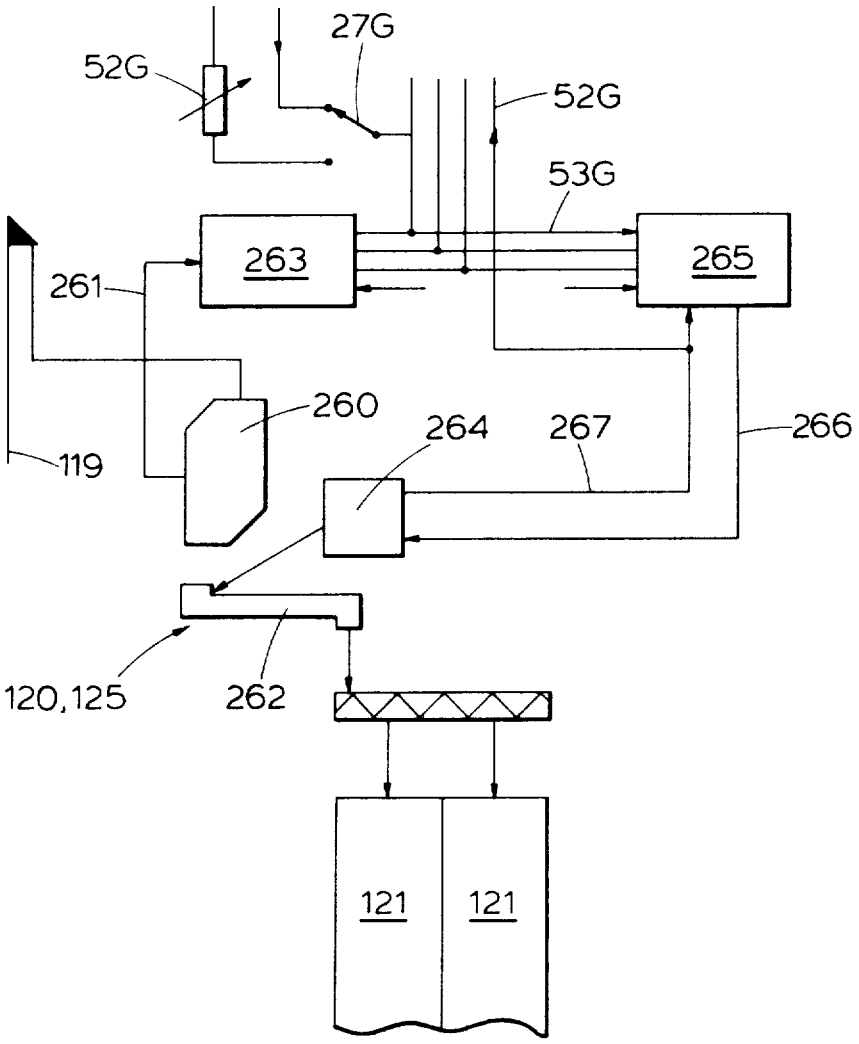
FIG. 8 shows in more detail the moisture control apparatus of FIG. 2.

Another example of a process element and process zone which can be controlled by the computer device 30 is the arrangement at the stations 120 and 125 in FIG. 2 for adding moisture to the wheat to be milled, this arrangement being illustrated in slightly more detail in FIG. 8. The grain to be moistened passes first through a moisture measuring device 260 which gives an electrical signal on the line 261 indicative of the moisture content of the grain. Based on the value indicated by the signal on the line 21, the amount of water needed to be added to the grain in the watering device which is indicated at 262, may be determined either locally in a device 263 or by the computer device 30. As a result of this determination, a flow rate for water flowing into the watering device 262 can be determined having regard to the flow rate of grain through the device, and this flow rate is controlled by a servo controlled valve 264 which is under the control of a servo amplifier control device 265. The device 265 is provided with an actual flow rate signal on the line 266 from a transducer within the valve 264 and this is available to the computer device 30 on the line **52*b*. A desired flow rate for the water is fed to the device 265 on the line 53*b* which can derive a value either from the computer device 30, or by operation of the switch 27***b* from the manually adjustable set value device 52*b*. Again the valve 264 may be manually adjustable, and a switch may be provided in the servo control line 267 between it and the control device 265. Thus it can be seen that the flow of water to the watering device can be operated under the so called first level of control or manual adjustment, or under second level of control by means of the set value device 52*b*, or under the third level of control by the computer device 30. Further the computer device 30 can be programmed to calculate appropriate amounts of water to be added having regard to the type of grain, the circumstances of the process and other ambient conditions such as temperature and humidity, etc., and on the basis of information provided to it by the device 260 and other sensors, it can provide a calculation of the time that the grain should rest in the silos 121 for the water added at this stage to be absorbed into the grain.

The blending arrangement of FIG. 9 is another example of a process zone which can be under the control of the computer device 30. If the miller enters requirements of the final product into the computer device 30, and it is suitably programmed, having regard to the other process parameters throughout the milling plant, the computer device 30 can control the operation of the flow valves 210 in FIG. 9 to create a blend of flour in the selected one of the conveyors 211. A signal on the line 215 from the colour intensity measuring device can be fed to the computer device 30, and by suitable programming, the computer device 30 can modify the operation of the valves 210 from a pre-stored or pre-set pattern to achieve a desired colour intensity value having regard to the product required and information entered to the computer by the miller. In a further arrangement the signals on the lines 215 may be fed to a servo amplifier device 219, where they are compared with a respective desired value signal derived from the computer device 30 (or by means of a switch device not shown with a manually set desired value) and the amplifier device 219 is arranged to control the valves 210 to achieve the desired colour intensity value.

While the above discussion has been directed more or less to the use of one computer device 30, it will be appreciated that various of the process zones may be controlled by separate computer devices such as that indicated at 30, for instance the zones arising in FIGS. 1, 2, 3 and 4 may be controlled by respective computer devices 30.

Figure 12:
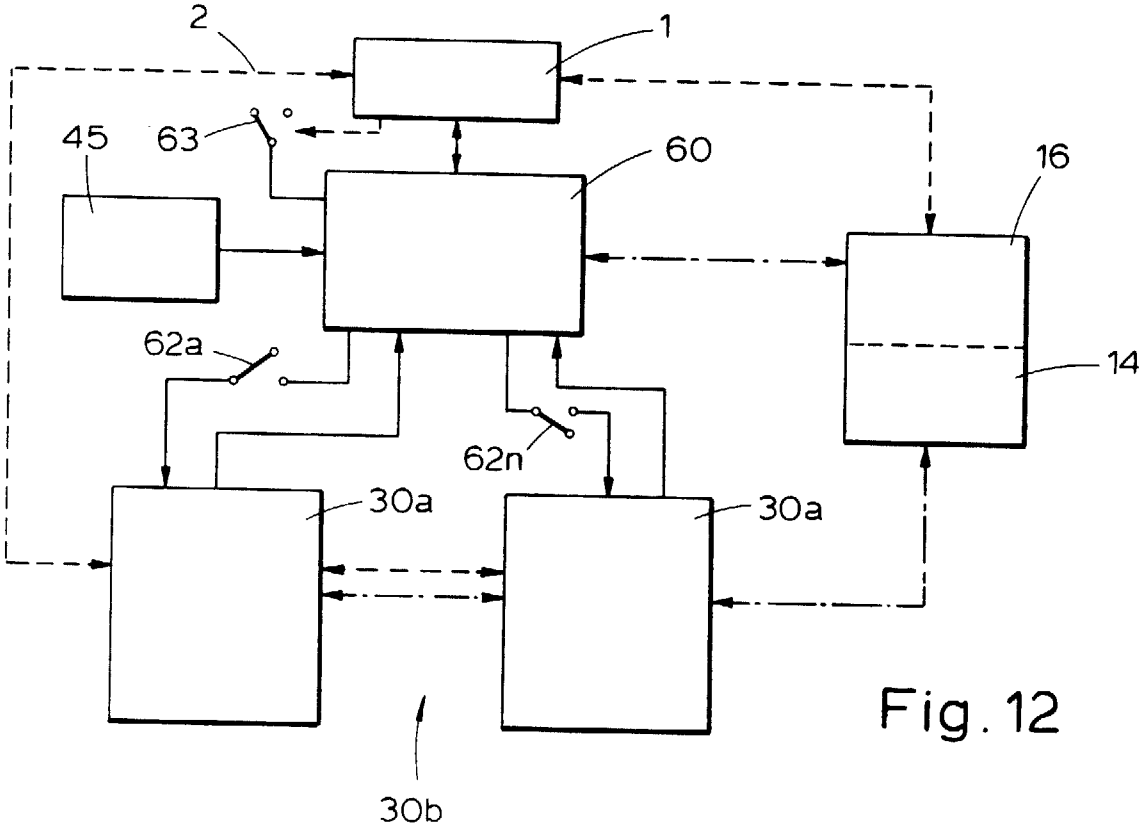
FIG. 12 shows a further level of control associated with the system of FIG. 6.
Figure 13:
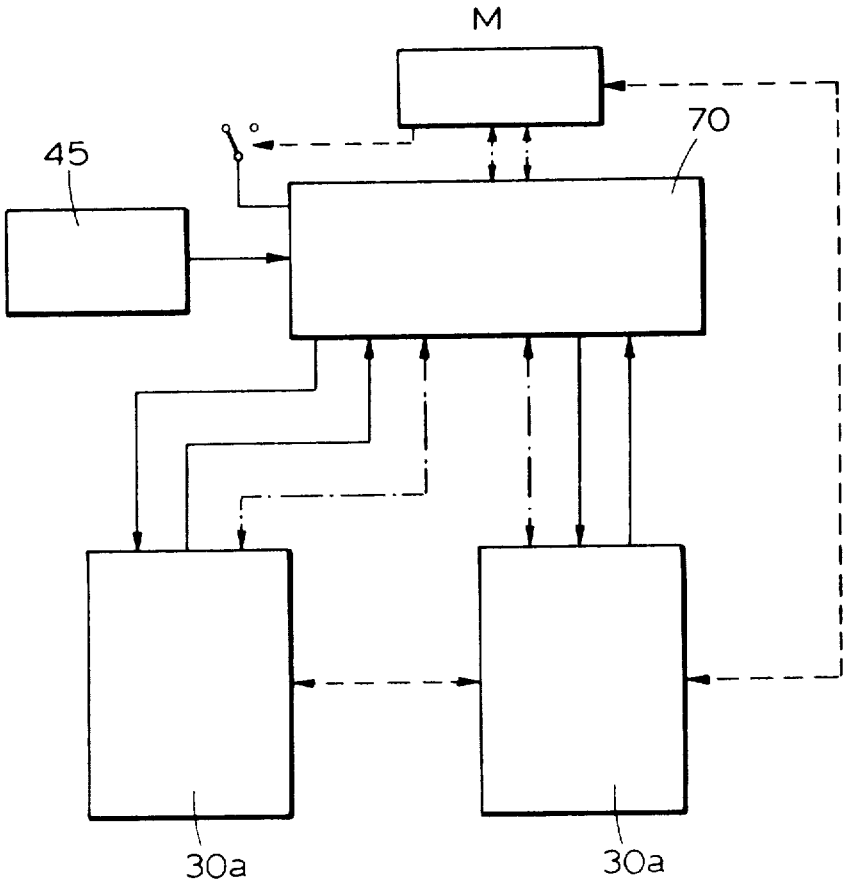
FIG. 13 shows an alternative arrangement of the system of FIG. 7.

FIGS. 12 and 13 show in schematic outline two versions of a fourth level of control in which such a series of control computer devices 30 may be connected to be under the direction of a main computer device 60. The main computer device 60 may be provided with keyboard entry display means and storage means whereby the miller may select in accordance with the programming of the main computer 60 various pre-stored overall operating schemes for the plant in accordance with the particular product which he has to handle at any time. The main computer 60 may be programmed to take care of the overall timing of the operation of the plant bearing in mind the various sequencing and delays for the product through various stages of the plant, and may take over the overall management of the plant on a week to week or month to month basis according to the predicted output requirements for the plant and expected intakes of various types of wheat and other material to be milled.

The main computer 60 may also derive information for book-keeping purposes from the various weighing devices through the plant and from flow measuring devices so that product stock control and financial and other management may be carried out for the whole plant by the computer device 60.

Again by means of switches 63 (FIG. 12) in the event of failure of the main computer 60, control may revert from the fourth to the third level of control under the individual computer devices 30. Again there can be interaction between the interlocking and actuating devices 14 and 16 with the main computer 60 and the miller.

With suitable programming the computer devices 30 discussed above, together with the computer 60 if such is used, may be programmed to take care of the management and operation of the whole milling plant. The head miller will be aware of the various types of cereal such as wheat or rye in a flour and semolina milling plant, or maize in a maize milling plant, which he has in stock in the intake storage silos 108. He will be aware of the needs into the future of the various types of flour that the plant is required to produce, and past experience will enable the various operating parameters for the various process zones in the machine to be stored in the memory of the computer. Thus the miller will be in a position to enter data relating to the types of cereal available from storage together with such details for the various types of wheat which may be hard wheats, soft wheats or durum wheats, the data being for example in terms of ash content, protein content and gluten content of the wheat. He may also enter into the computer details of the required finished product in terms of the cereal blend or wheat blend in terms of the percentage quantities of the various types of raw cereal which should be processed and blended into the finished product.

The miller can also enter into the computer data relating to the ambient conditions such as the moisture content of the wheat in storage, the time of year when the wheat was harvested in conjunction with the area from which the wheat has come, the time for which the wheat has been stored, the specific weight or density of the wheat and such other factors.

The computer can be initially provided with data of the various process elements in the plant such as the type and number of roller mills to be used, data of the characteristics of the various other process items such as wetting equipment, filtering equipment, purifiers and the various throughput capacities of such machines.

The computer can also be provided with target values which the miller wishes to achieve in the milling process, for instance the yield of white flour, the flour blend and quality, the brightness, the ash content, and baking properties.

By suitable programming the computer devices can be arranged to work on such input data and select from data stored within the computer memory on the basis of past experience in milling the cereals in question to whatever final product is desired, to provide output signals to the various process elements in various process zones to control those process elements in accordance with that past experience to produce the required product. Such output signals, as discussed above with respect to the described embodiment, immediately influence the parameter which they seek to control since the output signals are compared at each site with signals representing actual values of that parameter or with signals which vary simultaneously with that parameter in a servo loop system. Such an arrangement is to be distinguished from a situation where process parameters are varied to produce a change in result further down the process stream where a measurement or assessment of that result is used as an input signal to the control system.

Again as discussed above the miller can manually intervene in the second or first level of control in the various process zones to modify the operation of the plant against the operation determined by the computer so as to improve the operation against past experience, or against the mode proposed by the computer. These modified values can again as discussed be stored in the computer memory either as a separate group of values, or as a modification to the existing group of values which is being used at the time.

In this way it will be seen that the experience of the head miller can be stored away in the computer memory in such a fashion that the computer can make use of that experience in setting the various process elements in the various process zones of the plant to mimic the miller's own manner of operating the plant in the light of his experience.

It will be appreciated that the various servo systems, and indeed the computer devices can be provided with circuitry and where appropriate programming to monitor all the actual values of process parameters so that in the event that any of these exceed certain limits, for safety purposes the relevant process element can be shut down or other suitable alarm can be given. Again it will be appreciated that by suitable programming the computer or computers can be so arranged that the signal values supplied to the various process zones during start-up or shut down of the plant can be modified both as to magnitude and sequence of application to control safely the start-up and shut-down procedures, as well as operating in a steady state in a milling operation.

Figure 14:
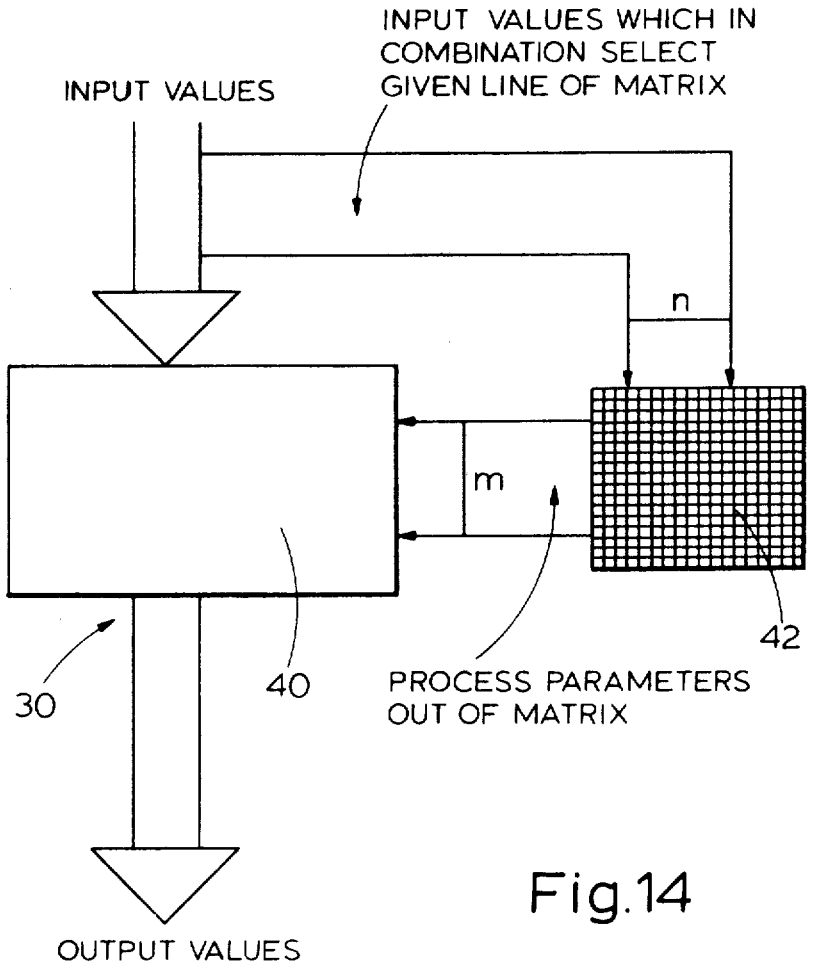
FIG. 14 shows in schematic form an arrangement of a storage device in the computer devices of FIGS. 10 to 13.
Figure 15:
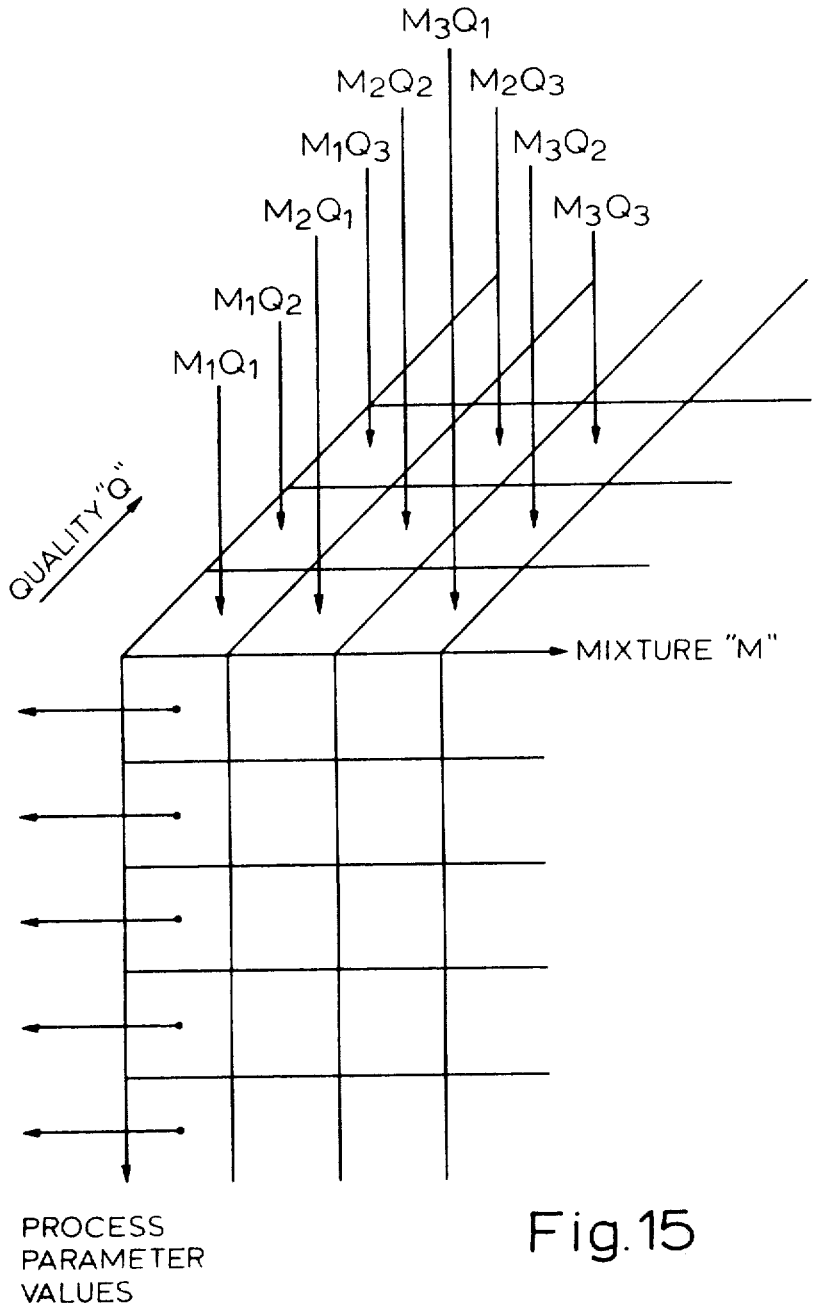
FIG. 15 shows in schematic form more detail of the storage device of FIG. 14.

FIGS. 14 and 15 illustrate schematically one possible arrangement in which the data relating to various process parameters may be stored in a memory matrix in one of the computer devices 30.

The memory 42 is preferably organised in a matrix fashion as shown schematically in FIG. 15 where data is shown stored in a three-dimensional matrix with the various process parameter values or output values stored in vertical columns, with tabulations of various mixtures of cereals disposed in rows to the left and right as seen in various qualities of finished product stored into and out of the plane of the paper in FIG. 15. Thus the computer on being given data as to the particular mixture of cereals and quality of finished product, can select the appropriate vertical column of process parameters which will give the required result.

In Table I below is set out a typical tabulation for mixtures, three being shown with various operating parameter values. The mixtures shown may be for instance made up with various percentages of Canadian wheat, two varieties of local wheat, some rye, and for instance some French wheat.

It can be seen from the above description, that the invention, and the various embodiments of it, provide a computer control arrangement which can considerably assist the miller in setting up a milling plant to deal with various raw cereal materials and finished products, and control it in its processing of the cereal to the finished product on an automatic basis.

TABLE I

| | Relationship between predetermined characteristics and operative parameters (control signals or storage date) | | | |
|---|---|---|---|---|
| Example: | 1. | 2. | 3. | |
| Cleaning | | | | |
| Mill throughput Tonne/h | 7.0 | 6.5 | 8.0 | |
| Mill throughput Tonne/h | (8.5) | (8.0) | (12) | |
| Mill throughput Tonne/h | (9.0) | (9.5) | (10) | |
| Grain mixture properties | | | | Predetermined |
| Canada western % | 10 | 30 | 25 | characteristics |
| Inland I % | 50 | 20 | 25 | |
| Inland II % | 10 | 10 | 20 | |
| Rye % | 5 | 5 | 10 | |
| French % | 25 | 35 | 20 | |
| Grain moisture content | | | | |
| Moisture content % | 16.5 | 16 | 17.2 | |
| Moisture content % | (16.2) | (15.8) | (17.0) | |
| Moisture content % | (16.8) | (16.5) | (17.3) | |
| Grain mixture M | M1 | M2 | M3 | Tangent values |
| Milling | | | | Predetermined |
| Grain mixture M | M1 | M2 | M3 | characteristics |
| Grain moisture content | 16.5 | 16.0 | 17.2 | |
| Mill throughput | 7.0 | 6.5 | 8.0 | |
| Roll gap B1 relative | 0.62 | 0.71 | 0.60 | operative |
| Roll gap B2 value | 0.44 | 0.47 | 0.48 | process |
| Roll gap B3 | 0.31 | 0.25 | 0.37 | parameters |
| Roll gap C1 | 0.151 | 0.172 | 0.142 | (control |
| Roll gap C2 | 0.132 | 0.151 | 0.135 | signals) |
| Roll gap C3 | 0.116 | 0.122 | 0.110 | |
| Milled material mixture | | | | Predetermined |
| Grain mixture | M1 | M2 | M3 | characteristics |
| Mill throughput | 7 | 6.5 | 8.0 | operative |
| Mix valve 1 | I | I | I | process |
| Mix valve 2 | | I | II | parameters |
| Mix valve 3 | III | II | II | (control signals) |
| Flour Quality Q | Q1, Q2, Q3 | Q1, Q3, Q5 | Q1, Q2, Q4 | Tangent |
| Flour Lightness % | I 100 | 100 | 100 | values |
| | II (90) | (95) | (90) | |
| | III (70) | (75) | (70) | |

TABLE I-continued

| | Relationship between predetermined characteristics and operative parameters (control signals or storage date) | | |
|---|---|---|---|
| Example: | 1. | 2. | 3. |
| Yield % | 80.5 | 79.3 | 78.5 |

What is claimed is:

1. An improved method of operating a cereal or grain milling plant having a plurality of processing zones selected from cleaning, roller milling, moistening, sifting or silo storage for the production of a milled product to a given specification such as flour, semolina and ground flour from initial cereal or grain having given characteristics wherein at least some of said zones have a plurality of sensors arranged to give output values in response to operating conditions of said zones of said plant the improved method comprising the steps of; optimally processing a plurality of types of grains and storing in a control device the output values from said sensors in association with the characteristics of the type of grain and the specification of the finished product during each of said optimal processings; selecting one of said optimal processes to be performed on an incoming cereal or grain to be milled having regard to the type of grain and of the finished product to be produced from it; associating each of the stored outputs of said sensors with said selected process in order to obtain a desired series of operating conditions; outputting from said control device a plurality of signals to control operating conditions in each of said zones so that said sensors read in accordance with said desired series of operating conditions.

2. A method as claimed in claim 1, in which the characteristic of the material to be milled used is the cereal type.

3. A method as claimed in claim 1 in which the characteristic of the material to be milled used is the area in which it was grown.

4. A method as claimed in claim 1 in which the characteristic of the material to be milled used is the time that it was harvested.

5. A method as claimed in claim 1 in which the characteristic of the material to be milled used is the cereal mixture.

6. A method as claimed in claim 1 in which the characteristic of the material to be milled used is the quality of the individual components of the cereal mixture.

7. A method as claimed in claim 1 in which the characteristic of the material to be milled used is the specific weight of the cereal.

8. A method as claimed in claim 1 in which the characteristic of the material to be milled used is the moisture content of the cereal.

9. A method as claimed in claim 1 in which the characteristic of the material to be milled used is the ambient temperature in which the process is conducted.

10. A method as claimed in claim 1 in which the characteristic of the material to be milled used is the ambient humidity in which the process is conducted.

11. A method as claimed in claim 11 in which the values from said sensors which are stored include the throughput of the cereal to be processed.

12. A method as claimed in claim 1 in which the values from said sensors which are stored include the temperature of the cereal to be milled.

13. A method as claimed in claim 1 in which the values from said sensors which are stored include the moisture content achieved in the cereal to be milled before milling by addition of water.

14. A method as claimed in claim 1 in which the values from said sensors which are stored include the mill roll gap.

15. A method as claimed in claim 1 in which the values from said sensors which are stored include the mill roll pressure.

16. A method as claimed in claim 1 in which the values from said sensors which are stored include the mill roll temperature.

17. A method as claimed in claim 1 wherein at least some of said zones have machines operating in said zones and wherein at least some of said output values of said sensors are directly related to said machines.

18. A method as claimed in claim 1 in which, for correlation between combinations of material and finished product characteristics and the control signals, the control signals are stored in an electronic date memory unit and an appropriate address signal is provided to select a desired group of control signals.

19. A method as claimed in claim 1, in which the control signals are used to represent desired values of operating parameters in respective control means of the process zones.

20. A method as claimed in claim 1 in which during start-up phase of operating said plant at least one of said selected group of control signals is modified.

21. A method as claimed in claim 20, in which said modification of a control signal is carried out in steps as a function of the time for which the process has been in operation since the moment of the process starting.

22. A cereal milling plant, especially for the production of flour, semolina and medium ground flour, having a number of process zones for example selected from the group comprising cleaning, roller milling, moistening, sifting and silo storage of the incoming cereal, intermediate and final products, at least one such process zone including a process apparatus which includes servo-control means and means for interlocking its operation with other apparatus in the milling plant; in which the servo-control means includes a set value generator for a process parameter of the respective process apparatus, an actual value sensor for that process parameter and comparator means with associated drive means to operate the servo-control means in a loop to maintain the parameter at a chosen value; and in which switching means is provided so that the servo-control means of the process apparatus in at least one of said zones may be disconnected so that the apparatus may operate independently of the servo-control loop.

23. A cereal milling plant, especially for the production of flour, semolina and medium ground flour, having a number of process zones for example selected from the group comprising cleaning, roller milling, moistening, sifting and (or) final products, in which at least one central control device, such as a computer device, is provided and arranged to provide control signals representative of a process parameter to control process apparatus in at least one such process zone, such process apparatus including servo-control means and means for interlocking its operation with other apparatus in the milling plant; in which the servo-control means includes a manually adjustable set value generator for a process parameter of the respective process apparatus, an actual value sensor for that process parameter and comparator means with associated drive means to operate the servo-control means in a loop to maintain the parameter at a chosen value; and in which switching means is provided so that the comparator means associated with such process apparatus in at least one of said zones may be connected to one of said central control device and the respective set value generator so that the servo-loop may operate selectively under the direction of one of said central control control device and the associated set value generator.

24. A cereal milling plant as claimed in claim 23, wherein said at least one central control device includes a plurality of central control devices and wherein a main computer is provided and arranged to control said plurality of central control devices.

25. A cereal milling plant as claimed in claim 23, in which each such process apparatus includes means for manually adjusting directly the operation of said process apparatus for varying the process parameter, and second switching means arranged to switch control of said process apparatus between said servo-control means and said manually adjusting means.

26. A cereal milling plant as claimed in claim 23, in which said process apparatus comprises a roller mill and the process parameter is the roll gap.

27. A cereal milling plant as claimed in claim 23, in which said process apparatus comprises a flow control device for cereal and the process parameter is the flow rate.

28. A cereal milling plant as claimed in claim 23 in which said apparatus comprises means for adding moisture to the cereal and said parameter is water flow rate.

29. A cereal milling plant as claimed in claim 23 in which said apparatus comprises a roller mill and the process parameter is the roller pressure.

30. A cereal milling plant as claimed in claim 23 in which the central control device is arranged to provide control signals to further process apparatus which are arranged to operate under servo loop control.

* * * * *